US005690557A

United States Patent [19]

Casillas et al.

[11] Patent Number: 5,690,557

[45] Date of Patent: Nov. 25, 1997

[54] PUTTING PRACTICE DEVICE

[76] Inventors: Roy C. Casillas; Judith L. Casillas, both of 1197 Hogan Ave., Banning, Calif. 92220

[21] Appl. No.: 712,138

[22] Filed: Sep. 11, 1996

[51] Int. Cl.[6] ..... A63B 69/36

[52] U.S. Cl. ..... 473/265; 473/278; 473/171; 473/162

[58] Field of Search ..... 473/265, 278, 473/171, 162

[56] References Cited

U.S. PATENT DOCUMENTS

| | | | |
|---|---|---|---|
| 2,750,195 | 6/1956 | Ching | 273/183 |
| 2,866,645 | 12/1958 | Cayot | 273/183 |
| 2,992,005 | 7/1961 | Lockhart | 273/183 |
| 3,414,266 | 12/1968 | Mitchell | 273/176 |
| 3,473,811 | 10/1969 | McGawn Lees | 473/278 |
| 3,542,369 | 11/1970 | Anderson | 273/186 |
| 3,586,335 | 6/1971 | D'Antonio | 473/265 |
| 3,934,882 | 1/1976 | Whittaker | 273/183 |
| 4,235,440 | 11/1980 | Hinckley | 273/183 |
| 4,387,896 | 6/1983 | O'Brien | 473/278 X |
| 4,988,106 | 1/1991 | Coonrod | 273/176 |
| 5,205,562 | 4/1993 | Hammon | 473/278 |
| 5,333,875 | 8/1994 | Wilson | 273/187.1 |
| 5,351,962 | 10/1994 | Lin | 273/186.2 |
| 5,409,231 | 4/1995 | Kueng et al. | 273/176 |
| 5,429,368 | 7/1995 | Adams | 273/192 |

*Primary Examiner*—George J. Marlo
*Attorney, Agent, or Firm*—Gene Scott; Patent Law & Venture Group

[57] ABSTRACT

A golf putting mat provides a pair of parallel raised portions separated for defining a putting stoke path. Each of the raised portions are constructed as a tubular sleeve with a rigid insert. Each of the sleeves accept two inserts arranged colinearly. The inserts are removable for folding the mat for compact portability. The mat provides a top layer of a golf green simulating material, a bottom layer providing support and non-slip characteristics and a middle layer for preventing the mat from being stretched out of shape when standing upon it.

2 Claims, 1 Drawing Sheet

PUTTING PRACTICE DEVICE

BACKGROUND OF THE INVENTION

This invention relates generally to a golf practice putting guide, and more particularly to such a guide that combines features of a fixed-in-place guide with a portable guide.

DESCRIPTION OF RELATED ART

The following art defines the present state of this field:

Adams, U.S. Pat. No. 5,429,368 describes a portable practicing putting device having a plurality of elongated panels that are connected together by hinges to form an elongated structure. A sheet of grasslike material is bonded to the top surface of the panels and it has a putting hole portion having a golf ball receptacle in it. An elongated strip portion extends tot he front end of the elongated structure. A putting stroke zone is formed adjacent the front end of the elongated structure and it has a plurality of lines of golf tee apertures extending parallel to the putting stroke zone. When not in use, the practice putting device can be folded up into a compact closing state.

Mitchell, U.S. Pat. No. 3,414,266 describes a golf rug having three longitudinal area strips, each having a different pile height and disposed in a graduated manner from least height to tallest height. These area strips are sewn together with the aid of narrow demarcation strips of contrasting color disposed therebetween.

Cayot, U.S. Pat. No. 2,866,645 describes an invention that relates to a putting practicer for golfers. The invention has simplified putting practicer devices, which comprises a plate having a pair of upstanding parallel rails, the height of the rails being substantially less than the radius of a golf ball, and the distance between said rails being slightly greater than the length of the chord struck through said ball by a line joining the tops of said rails and sufficient to guide a golfball placed on said plate between said rails, in substantially straight line movement along the parallel to said rails.

Ching, U.S. Pat. No. 2,750,195 describes a putting green for correcting the putting stroke of a golfer. This invention has among its features a platform where a golfer takes his putting stance, a putter guide carried by the platform and extending upwardly adjacent one edge, and a lip carried by the platform and extending outwardly adjacent to the putter guide, and the lips carrying guide lines that extend perpendicularly.

Coonrod, U.S. Pat. No. 4,988,106 describes a portable, practice golf putting green presents realistic and challenging putting practice and in which all of the components can be formed into a convenient and compact storage position. The preferred putting green includes a flexible base of material presenting a playing surface providing two different resistances to the roll of a golf ball and realistically simulative of a golf green cups defined in the playing surface, and elevated portion level, and a pair of longitudinally and transversely adjustable wedges for selectively altering the contour of the playing surface.

Lockhart, U.S. Pat. No. 2,992,005 describes a putting guide which can be utilized as an aid for instruction in the art of putting. Features of this invention are providing a putting guide that enables both directional and distance requirements for putting to be learned with relative ease, the putting guide in use will visually indicate any error in an established putting stroke so that correction can be made, the precise structure of the putting guide can be used on a putting green or on indoor carpet, and the simple construction of the putting guide renders a unit that can be manufactured inexpensively even though it be strong and wear resistant.

Anderson, U.S. Pat. No. 3,542,369 describes a portable practice mat made of felted sisal fibers has its ends faced by a plastic material. A tee with a wide base extends upward through a centrally located hole in the mat. Indicia on the plastic material shows the direction of the target and the path that the head of the club should follow to drive a ball from the tee to said target. Additional indicia shows the proper position of the golfers feet.

Hinckley, U.S. Pat. No. 4,235,440 describes a device for aligning the face and swing of a golf club comprising an elongated body having a parallel sides with a direction line extending midway of the body and a series of arrows having their points on the center line and each arrow with a base at right angles tot he center line extending from edge to edge of the body.

Lin, U.S. Pat. No. 5,351,962 describes a golf putting practice device permitting inspection of linear perpendicular movement gravitational center of a putting club, composed of a connecting seat, a perpendicular standard strip and a pad member, wherein the pad member is rectangular, formed with a standard line and a circle positioned at a middle portion of the standard line, whereby during the movements the player is able to inspect whether the standard strip is overlapped on the standard line and correct the linear perpendicular putting movement to place the gravitational center of the putting club on the line connecting the golf ball and the ball hole so as to achieve a correct putting track and attitude.

Kueng et al., U.S. Pat. No. 5,409,231 describes a putting accuracy training aid providing an elongated, flat rolling surface and a non-slip base. A recessed tee supports a ball forward of an adjustable stroke gauge and elostomer limit stop. Inclined surfaces, projections and/or grooves provided adjacent the tee facilitate re-teeing without stooping. Jointed multi-section constructions are also disclosed having a sectional body and/or wing attachments.

Whittaker, U.S. Pat. No. 3,934,882 describes a thin, flat member longer than its width has parallel sides and one end formed at a fight angle thereto and notched midway between the sides, the other opposite end being pointed. A visible line is formed on the longitudinal axis and extends from the mid portion of the notch on the one end to the apex of the pointed end. The upper surface of the thin flat member is preferably reflective material which enables a golfer to see whether or not his head is over the ball and improves the golfer's view of club head movement after striking the ball. The notch forms a location for a golf ball. The flat member may be creased along its longitudinal axis to facilitate folding. In use the golf guide forms a visual path for the golf club after the golf ball is hit together with a transverse plane of reference for alignment with the head of a golf club when the golf ball is hit.

Wilson, U.S. Pat. No. 5,333,875 describes and alignment system for aiding in the alignment of a golf club with a golf ball prior to hitting the golf ball includes a pad of material having a bottom surface for placement on a support surface, and a resilient top surface on which the golf ball is to be placed for hitting. Also included are first and second stripes defined in the top surface of the pad in a side-by-side, generally parallel relationship at or near the location at which the golf ball is to be placed, for enabling the visual alignment of the golf club head relative to the stripes and the golf ball.

The prior art teaches certain putting devices and importantly, the use of parallel markers or raised portions for improved guidance and teaching putting control. However, the prior art does not teach that such raised portions can be constructed in such a manner as to present a rigid structure while being easily broken down for compact folding and portability. The present invention fulfills these needs and provides further related advantages as described in the following summary.

SUMMARY OF THE INVENTION

The present invention teaches certain benefits in construction and use which give rise to the objectives described below.

The present invention provides a golf putting mat having a pair of parallel raised portions constructed as a tubular sleeve with a rigid insert. The inserts are removable for folding the mat for compact portability. The mat provides a top layer of a golf green type material, a bottom layer for support and non-slip characteristics and a middle layer for preventing the device from being stretched out of shape.

A primary objective of the present invention is to provide a golf putting mat that provides a rigid guide framework while also providing portability through being folded compactly. Another objective is to provide a mat as described that is not able to be stretched out of shape.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE PREFERRED EMBODIMENT

Figure 1:
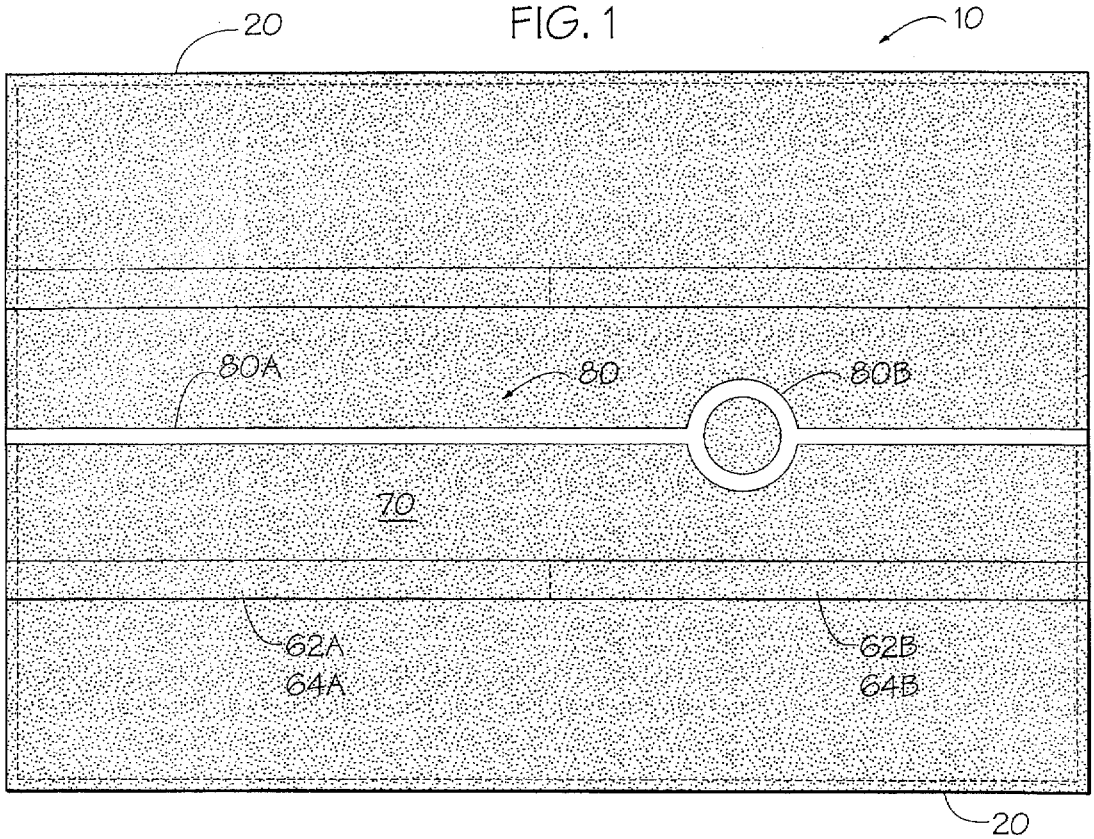
FIG. 1 is a top plan view of the present invention as laid flat.

The above described drawing figures illustrate the invention, a golf ball putting guide device. The device includes a mat 10 having a periphery 20, a predetermined thickness 30, a bottom surface 40 for placement on a flat support surface (not shown), generally a indoor floor surface, a surface in a park or other outdoor setting, or a surface on a golf links, such as a putting green. The device also includes a top surface 50 on which a golf ball (not shown) is to be placed for hitting with a golf club (not shown). The bottom surface 40 is preferably of a rubber-like material with a high coefficient of friction so that the mat will not slide on the flat support surface. The top surface 50 is highly characteristic of a golf green so that the look and feel of the surface enables a golfer to simulate an outdoor golf putting experience. Further it is important that the golf ball react in a way that closely simulates its behavior on a putting green so as to assure the golfer that his practice on the device will improve his ability on the green.

The mat further provides first and second parallel oriented raised guide portions 60A and 60B extending uniformly upwardly from the top surface 50 and substantially along the top surface to define an elongate, uniform width, area 70 of the top surface 50 within which to strike the golf ball with the golf club. The uniform width 75 is preferably just slightly wider than the face of the putter golf club. Width 75 is made with a tolerance appropriate to the skill of the golfer. The professional golfer will require a small tolerance, while the amateur will require a larger one. The raised portions 60A,B are of a height to act as a physical guide and tactile feedback device for the golfer. Should the golf club be moved into contact with either of the raised portions 60A,B during a swing, the golfer receives tactile warning that his club is out of proper placement at a particular point of his swing when the club touches the one of the raised portions 60A, B. This is identical to the experience a golfer has if his club strikes the putting surface during a swing, and is important in teaching improvement in the stroke. The raised portions 60A,B also provide visual guidance to the golfer when the ball moves away from his club, as it is quite easy to see if the ball is moving parallel to the raised portions 60A,B.

Further, a marking 80 on the top surface 50 preferably provides, first, a line 80A laying parallel to the raised portions 60A,B and bisecting the elongate top surface area 70, and, second, an indicator 80B for guiding the placement of the golf ball onto the same location on the top surface each time it is placed. Such a marking 80 is preferably an ink stenciling or screening so that it has negligible thickness due to the fact that it is imbedded or soaked into the top surface 70 and does not, therefore, affect the ball as the ball moves over it. The line 80A enables the golfer to see how far off center the ball trajectory is after the ball is hit.

Figure 2:
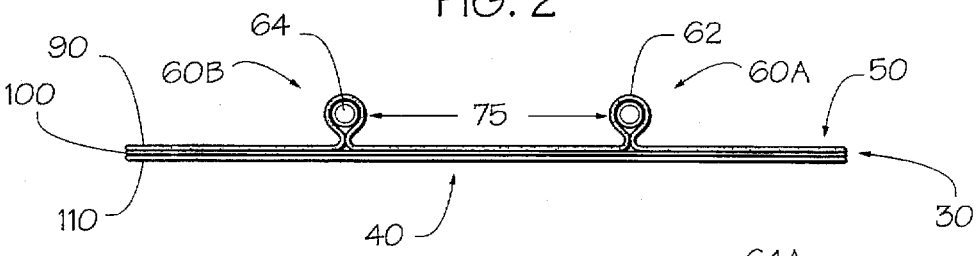
FIG. 2 is a side elevational view thereof showing the locations of a set of elongate rods of the invention within tubular pockets of the invention.
Figure 3:
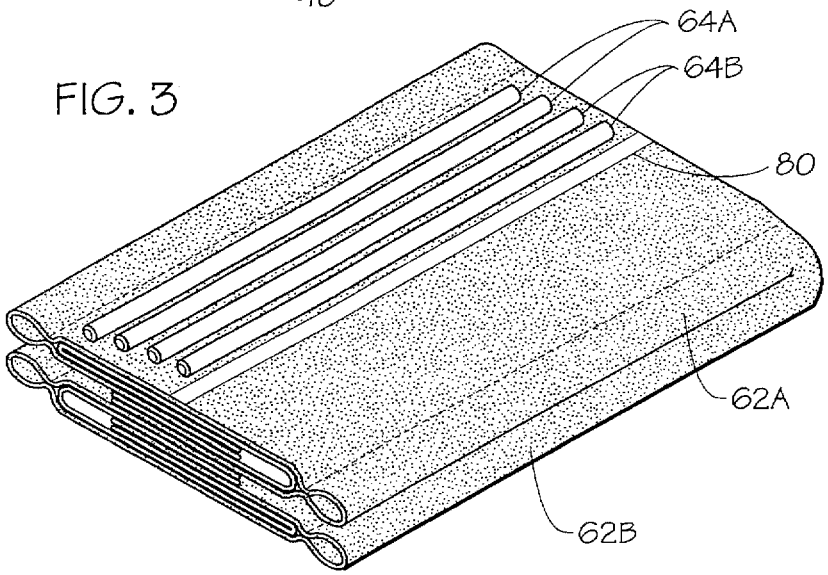
FIG. 3 is a perspective view thereof shown as folded and with the set of rods of the invention separated from the tubular pockets.

Preferably, as shown in FIG. 2, the mat comprises a top layer 90 of an artificial turf-like fabric such as a felt material, a middle layer 100 of a non-stretchable fabric such as a tight woven scrim material or a non-extensible plastic sheet stock, and a bottom layer 110 of a flexible rubber-like material such as foam rubber. The predetermined thickness 30 is devised so mat 10 is able to be folded compactly as shown in FIG. 3 for compact storage and portability.

The raised portions 60A,B each comprise a tubular outer shell 62 preferably a contiguous part of the top layer fabric, and a rigid rod means 64 fitted within the shell. Preferably each shell 62 provides two joined and contiguous shell portions 62A and 62B, and each of the rod means 64 includes a pair of rods 64A and 64B, each of the rods 64A,B being sized to fit snugly within one of the shell portions 62A,B, the rods being of such length as to be accessible for manual removal from the shell portions 62A,B for enabling the mat to be folded for compact storage. It should be understood that it is important to present a rigid and well defined structure for the raised portions 60A and 60B so as to enable consistent repeatable results in practice, i.e., for a given swing error, a given tactile response is presented by the raised portions 60A and 60B. Yet it would seem that this capacity in the instant invention can only be achieved by a fixed rigid device that is not foldable and is certainly not portable. The solution, in the present invention, is obtained by providing the above described structure of the raised portions 60A and 60B which present the necessary operating characteristics while enabling the device to be compactly folded, carried in a case or hand bag and made available at any time or place. This is important on the tour.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A golf ball putting guide device comprising:

a mat having a bottom surface for placement on a generally flat support surface, and a top surface for hitting a golf ball, the top surface being characteristic of a golf green;

first and second mutually parallel raised guide portions extending uniformly upwardly from the top surface and substantially along the top surface to define an elongate, uniform width, area of the top surface within which to strike the golf bail with a golf club;

a marking on the top surface, the marking providing; first, a line laying parallel to the raised portions and bisecting the elongate top surface area, and, second, an indicator for guiding the repeated consistent common placement of the golf ball onto the top surface;

each of the raised portions comprise a tubular outer shell formed as an extension of the top surface and protruding therefrom, each of the outer shells comprising two joined and colinear shell portions, each of the shell portions enclosing a rod fitted snugly within the each of the shell portions, the rods being removable from the shell portions for enabling the mat to lie folded for compact storage.

2. The device of claim 1 wherein the mat comprises a top layer of an artificial turf-like fabric, a middle layer of a non-stretchable fabric, and a bottom layer of a flexible rubber-like material.

* * * * *